US009341020B1

(12) United States Patent
Kao

(10) Patent No.: US 9,341,020 B1
(45) Date of Patent: May 17, 2016

(54) SINGLE PULL-CORD CONTROLLER OF ROMAN SHADE

(71) Applicant: UNI-SOLEIL ENT. CO. LTD., Tainan (TW)

(72) Inventor: Yu-Ting Kao, Tainan (TW)

(73) Assignee: Uni-Soleil Ent. Co., Ltd., Tainan (TW)

( * ) Notice: Subject to any disclaimer, the term of this patent is extended or adjusted under 35 U.S.C. 154(b) by 0 days.

(21) Appl. No.: 14/666,504

(22) Filed: Mar. 24, 2015

(51) Int. Cl.
*E06B 9/38* (2006.01)
*E06B 9/262* (2006.01)

(52) U.S. Cl.
CPC . *E06B 9/38* (2013.01); *E06B 9/262* (2013.01); *E06B 2009/2622* (2013.01)

(58) Field of Classification Search
CPC ..... E06B 2009/2622; E06B 2009/2625; E06B 2009/2627; E06B 2009/3225; E06B 2009/3227
USPC ..... 160/84.01, 84.04, 84.05, 170, 171
See application file for complete search history.

(56) References Cited

U.S. PATENT DOCUMENTS 4,466,475 A * 8/1984 Saito ..... E06B 9/90 160/297
5,791,393 A * 8/1998 Judkins ..... E06B 9/322 160/308
5,890,529 A * 4/1999 Haarer ..... E06B 9/78 160/319
6,129,131 A * 10/2000 Colson ..... E06B 9/262 160/171
6,142,211 A * 11/2000 Judkins ..... E06B 9/262 160/308
7,128,126 B2 * 10/2006 Smith ..... E06B 9/262 160/121.1
7,665,507 B2 * 2/2010 Naoki ..... E06B 9/42 160/170
8,191,605 B2 * 6/2012 Kwak ..... E06B 9/42 160/193
8,356,653 B2 * 1/2013 Fu-Lai ..... E06B 9/322 160/170
8,844,605 B2 * 9/2014 Ng ..... E06B 9/42 160/170
2009/0120593 A1 * 5/2009 Lesperance ..... E06B 9/322 160/84.02
2011/0290429 A1 * 12/2011 Cheng ..... E06B 9/262 160/84.02
2013/0220561 A1 * 8/2013 Yu ..... E06B 9/322 160/340

FOREIGN PATENT DOCUMENTS

TW M261586 9/1993
TW M290529 12/1994
TW M420276 U1 1/2012

* cited by examiner

*Primary Examiner* — David Purol
(74) *Attorney, Agent, or Firm* — Rosenberg, Klein & Lee

(57) ABSTRACT

A single pull-cord controller of roman shade comprises: a main control unit, a winding member, a first shaft member, a second shaft member, an inner bushing, an outer bushing, and a coupling unit. By the single pull-cord controller of the present invention, the up-down operation of the roman shade can be controlled by the pulling or releasing of a single pull-cord, and the pull-cord after manipulation can be wound within the controller by the recovery of the clock spring. Therefore, dangerous state of strangulation by wrapping around children's neck can be effectively avoided to achieve the object of safety precaution.

2 Claims, 9 Drawing Sheets

SINGLE PULL-CORD CONTROLLER OF ROMAN SHADE

BACKGROUND OF THE INVENTION

1. Field of the Invention

This invention relates to a single pull-cord controller of roman shade, more particularly to a novel pull-cord controller having safety precaution in which a single pull-cord can be wound for storage without being exposed outside too long so as to achieve the purpose of strangulation prevention.

2. Brief Description of the Prior Art

Conventional window curtains have a variety of options depending on its use, such as traditional fabric curtains, roller blinds, roman shade and window blinds. Regardless of the type of window curtains, the difference between the size and length do exist among them, so that the length of each window curtains can match the window frame so as to achieve perfect shielding effect.

The roman shade (also called roman blinds, pleated blinds or horizontal blinds) is developed by the curtain industries, in which a rolling fabric or a curtain body made by the other material is driven by controlling the winding and unwinding of a drawstrings with a curtain top-mandrel unit, so as to form pleated, waves, or flat folding pattern. Generally, the drawstring is connected to the lower portion of the curtain body. When the curtain body is to be rolled up, the drawstring is wound up so as to initiate the rolling up of the curtain body from the lower portion thereof. However, the controller for controlling the up-down of the curtain body includes a bead chain unit having a bead chain rope; the bead chain unit can drive a reel for winding the drawstring. When the bead chain rope enabling dual direction control is pulled, the bead chain unit can drive a reel to wind or unwind the drawstring so as to achieve up-down of the curtain. This type of structure can be seen in a Taiwanese Patent Gazette No. M290529 entitled "Bead Chain Control Unit Structure of Window Curtain" opened to public on May 11, 2006, a Taiwanese Patent Gazette No. M 261586 entitled "Bead Chain Control Unit Structure of Pleated Curtain" opened to public on Apr. 11, 2005, and a Taiwanese Patent Gazette No. M420276 entitled "Controller Structure of Roman Shade" opened to public on Jan. 11, 2012.

The conventional roman shade has a looped bead chain rope (pull-cord) to control bi-directional action of folding and unfolding of the curtain body. Depending on the window frame on site, the length of the looped bead chain rope is tailored to fit the total installation. If there is no suitable holder to fix the looped bead chain rope, it is often got entangled easily. In more serious condition, if the looped bead chain rope is played by ignorant children, it is easily got tying around children's body or neck and it is often difficult for children to get rid of it and hence hazard may occur. Therefore, this is the problem the concerned industries strongly want to improve.

In view of the above problem, the inventor of the present invention hereby proposes a single pull-cord controller of roman shade according to the improvement conducted on the disadvantages of prior art and based on his abundant experience in product development and manufacturing in relevant field, so as to achieve better practical value.

SUMMARY OF THE INVENTION

The main object of the present invention is to provide a single pull-cord controller of roman shade, more particularly to a novel pull-cord controller having safety precaution in which a single pull-cord can be wound for storage without being exposed outside so as to achieve the purpose of strangulation prevention.

The object and effect of the single pull-cord controller of roman shade of the present invention is achieved by the following technology.

The single pull-cord controller of roman shade of the present invention mainly comprises: a main control unit, with an outer sleeve fitted over its outside, having a first housing cavity and a second housing cavity. A winding member is installed within the first housing cavity of the main control unit. A first shaft member is provided in the bore of the winding member, and the first shaft member is fitted with a second shaft member. The second shaft member is fitted thereon a first torsion spring member, a second torsion spring member, an inner bushing and an outer bushing in this sequence, and is received within the second housing cavity. A central aperture is provided on the bottom end of the second housing cavity for the passing-through of a coupling unit assembled with the inner bushing. The winding member has a chamber for housing a first shaft member and a clock spring. The winding member is provided with a winding passage for winding up the pull-cord and a protruding block provided on its end. The outer bushing has aisle paths provided correspondingly to the protruding portions. In this manner, by the single pull-cord controller of the present invention, the up-down operation of the roman shade can be controlled by the pulling or releasing of the single pull-cord, and the pull-cord after manipulation can be wound within the controller by the recovery of the clock spring. Therefore, dangerous state of strangulation by wrapping around children's neck can be effectively avoided to achieve the object of safety precaution.

According to the above single pull-cord controller of roman shade, the first housing cavity of the main control unit is provided with an external cover on one side thereof for closing the first housing cavity.

According to the above single pull-cord controller of roman shade, a cord hole for the passing-through of a pull-cord is provided within the first housing cavity of the main control unit.

According to the above single pull-cord controller of roman shade, The other end of the outer bushing opposite to the aisle paths is provided with tooth portions; while the coupling unit has tooth blocks corresponding to and detachably meshing with the tooth portions on the outer bushing.

According to the above single pull-cord controller of roman shade, the outer bushing has a blocking edge provided in the inner diameter so as to correspondingly press against the second torsion spring member. According to the above single pull-cord controller of roman shade, the aisle path includes a straight segment and a slant segment.

According to the above single pull-cord controller of roman shade, Projections are provided on the outer periphery of the inner bushing, an arc protruding section is interposed between two aisle paths, each of the arc protruding sections is formed with a projecting teeth corresponding to and meshing with the protruding block of the inner bushing.

Based on the foregoing description of the constitution and the implementation of the present invention, the present invention has the following advantages when comparing with conventional structures:

1. The present invention can conduct the up-down operation of the roman shade by a single pull-cord.

2. By the single pull-cord controller of the present invention, the up-down operation of the roman shade can be controlled by the pulling or releasing of the single pull-cord, and the pull-cord after manipulation can be wound within the controller by the recovery of the clock spring. Therefore, dangerous state of strangulation by wrapping around children's neck can be effectively avoided to achieve the object of safety precaution.

DETAILED DESCRIPTION OF PREFERRED EMBODIMENTS

The objects, the technical contents and the expected effects of the present invention will become more apparent from the detailed description of the preferred embodiment in conjunction with the accompanying drawings.

Figure 1:
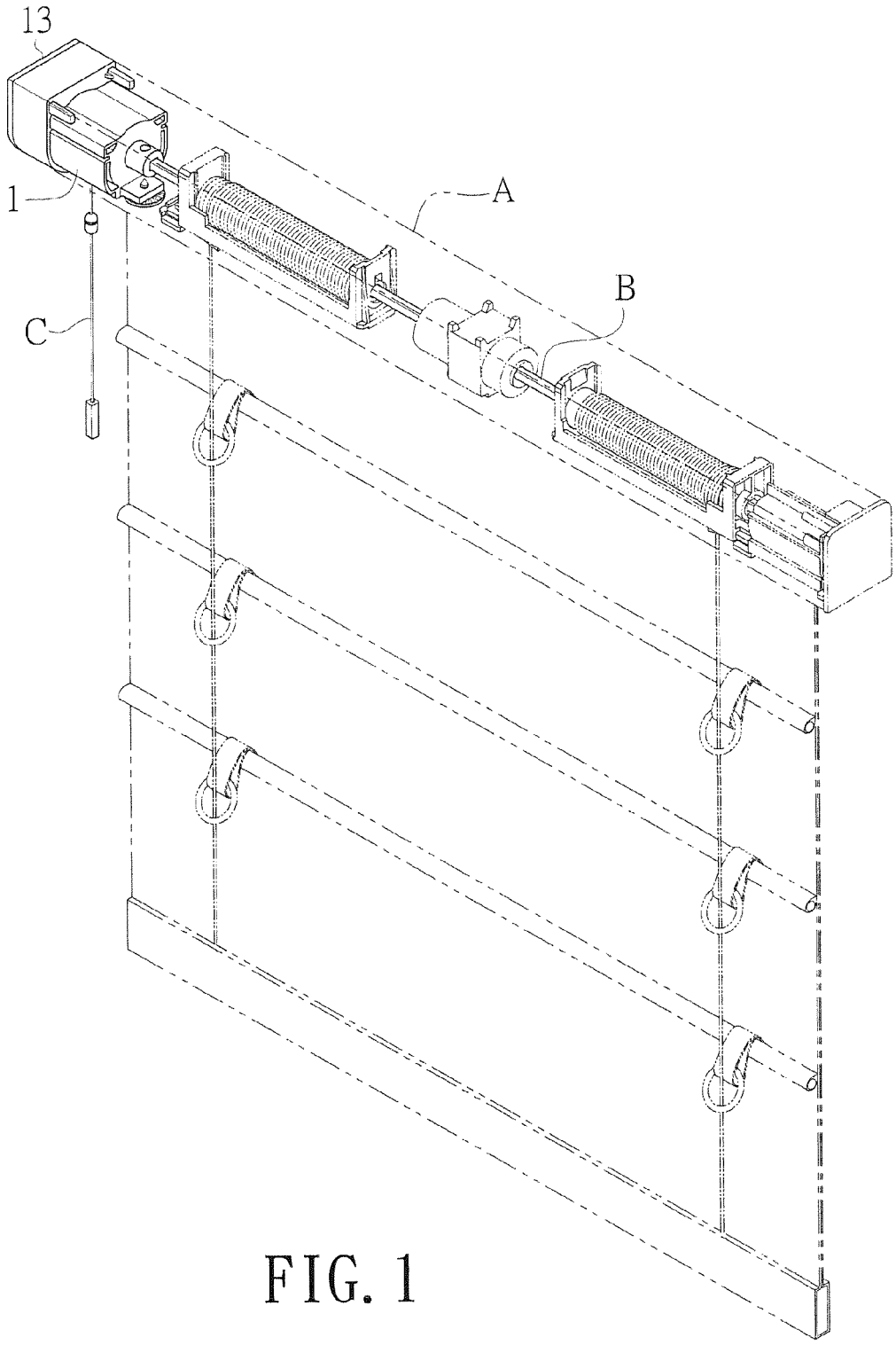
FIG. 1 is an overall schematic view of the appearance of the present invention.
Figure 2:
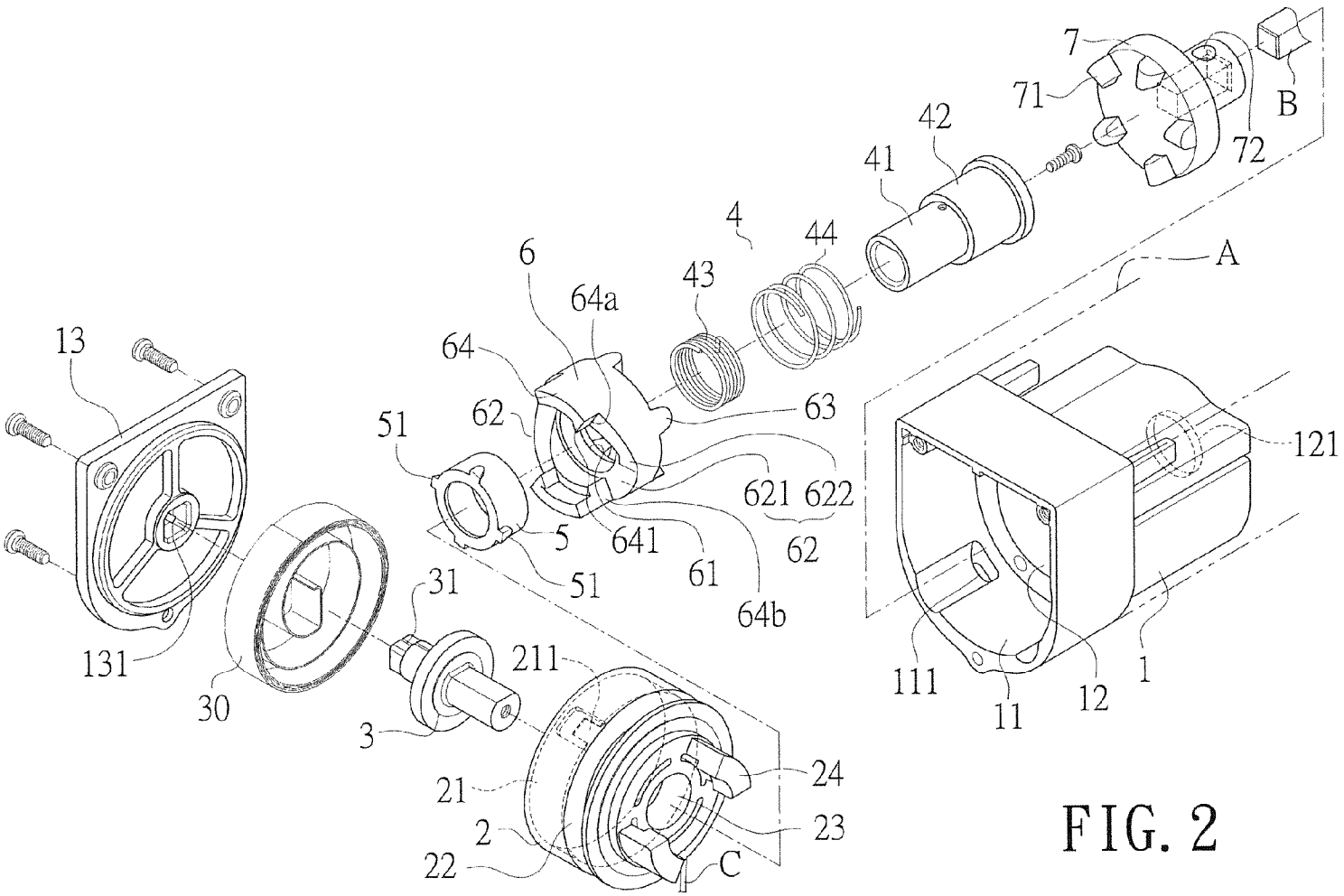
FIG. 2 is a perspective exploded schematic view of the present invention.
Figure 3:
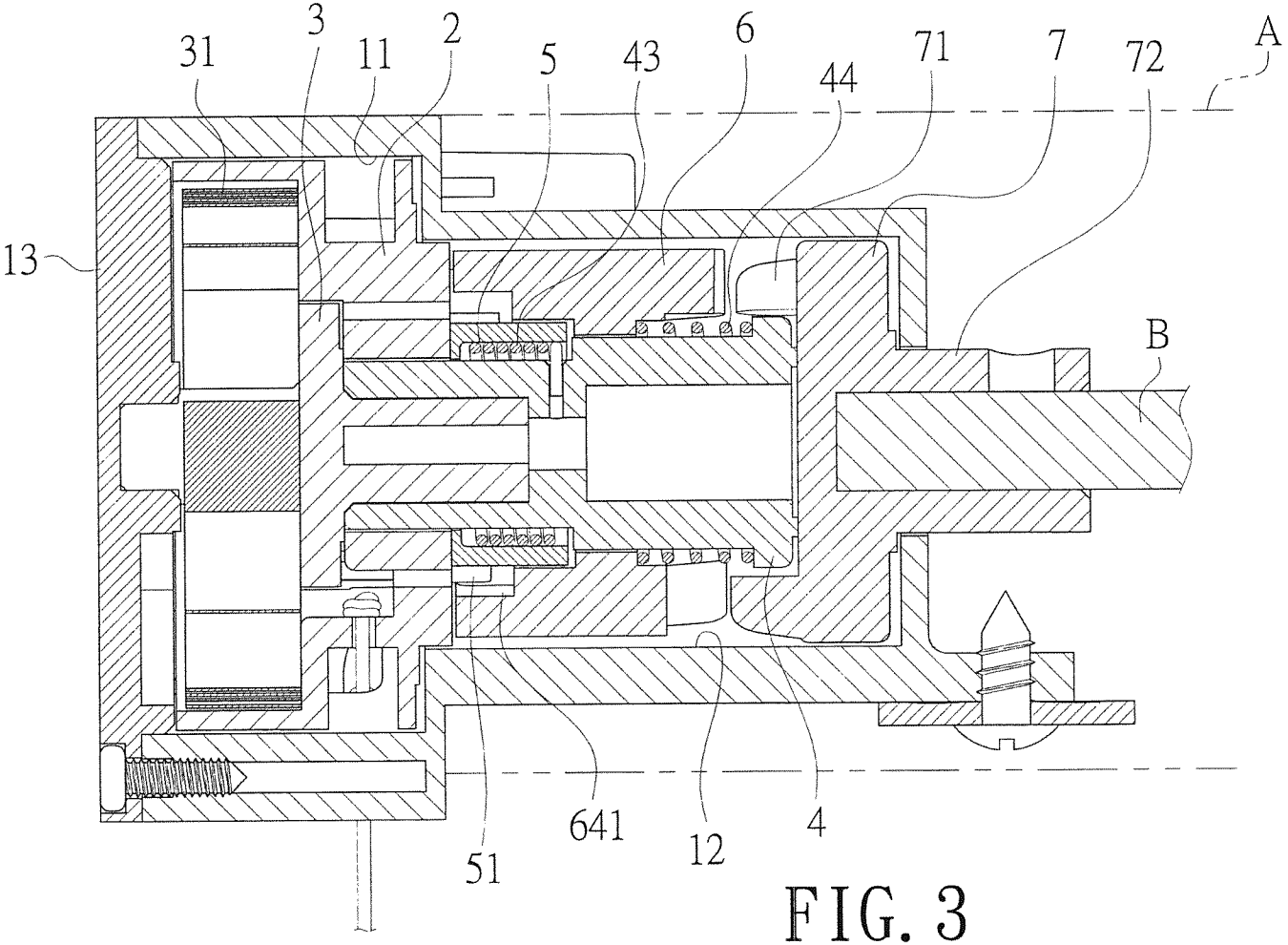
FIG. 3 is a sectional schematic side view of the present invention.

Firstly referring to FIGS. 1 to 3, the single pull-cord controller of roman shade of the present invention mainly comprises:

a main control unit (1), with an outer sleeve (A) fitted over its outside, has a first housing cavity (11) and a second housing cavity (12) with a central aperture (121) provided at the end face thereof. The open end of the first housing cavity (11) is provided with an external cover (13) which has a stationary shaft holding depression (131) provided at its center so that the external cover (13) can close the first housing cavity (11). Further, a cord hole (111) is provided within the first housing cavity (11);

a winding member (2) located correspondingly within the first housing cavity (11) of the main control unit (1). The winding member (2) has a chamber (21) and a winding passage (22). A bore (23) is provided at the center of the chamber (21) for the passing-through of the winding member (2), and a fixing tab (211) is provided on the inner wall of the chamber (21). The winding passage (22) is provided outside the winding member (2) so as to wind up a pull-cord (C), and the pull-cord (C) pierces out through the cord hole (111). Further, at least one protruding block (24) is provided on the wall surface of the winding member (2) corresponding to the bore (23);

a first shaft member (3), correspondingly provided in the bore (23) of the winding member (2). A first end of the first shaft member (3) has a slit groove (31) for inserting one end of a clock spring (30) therein. The clock spring (30) is located in the chamber (21) of the winding member (2), and the other end of the clock spring (30) is fixed onto the fixing tab (211) provided on the inner wall of the chamber (21). The first end of the first shaft member (3) is inserted in the stationary shaft holding depression (131);

a second shaft member (4), positioned in the second housing cavity (12) of the main control unit (1), which has a first step segment (41) and a second step segment (42). The inner diameter of the first step segment (41) is fitted with the second end of the first shaft member (3). A first and a second torsion spring members (43), (44) are respectively fitted over the first step segment (41) and the second step segment (42);

an inner bushing (5), enclosing over the first torsion spring member (43) and fitted over the first step segment (41) of the second shaft member (4). Projections (51) are provided on the outer periphery of the inner bushing (5);

an outer bushing (6), correspondingly fitted over the second step segment (42) of the second shaft member (4). A blocking edge (61) is provided within the inner diameter thereof, so as to correspondingly press against the second torsion spring member (44). The outer bushing (6) has aisle paths (62) provided correspondingly to the protruding blocks (24) and the aisle paths (62) are in moving contact by the protruding blocks (24). Each of the aisle paths (62) has a straight segment (621) and a slant segment (622), and an arc protruding section (64) is interposed between two aisle paths (62). Each of the arc protruding sections (64) is formed with projecting teeth (641) adjacent to the slant segment (622) and extending in radial direction. The other end of the outer bushing (6) opposite to the aisle paths (62) is provided with tooth portions (63);

a coupling unit (7) having tooth blocks (71) corresponding to and detachably meshing with the tooth portions (63) on the outer bushing (6). The coupling unit (7) is located within the second housing cavity (12) of the main control unit (1), and a shaft tube (72) at one end of the coupling unit (7) penetrates through the central aperture (121) of the main control unit (1) so as to assemble with a mandrel rod (B) for the window curtain.

Figure 4:
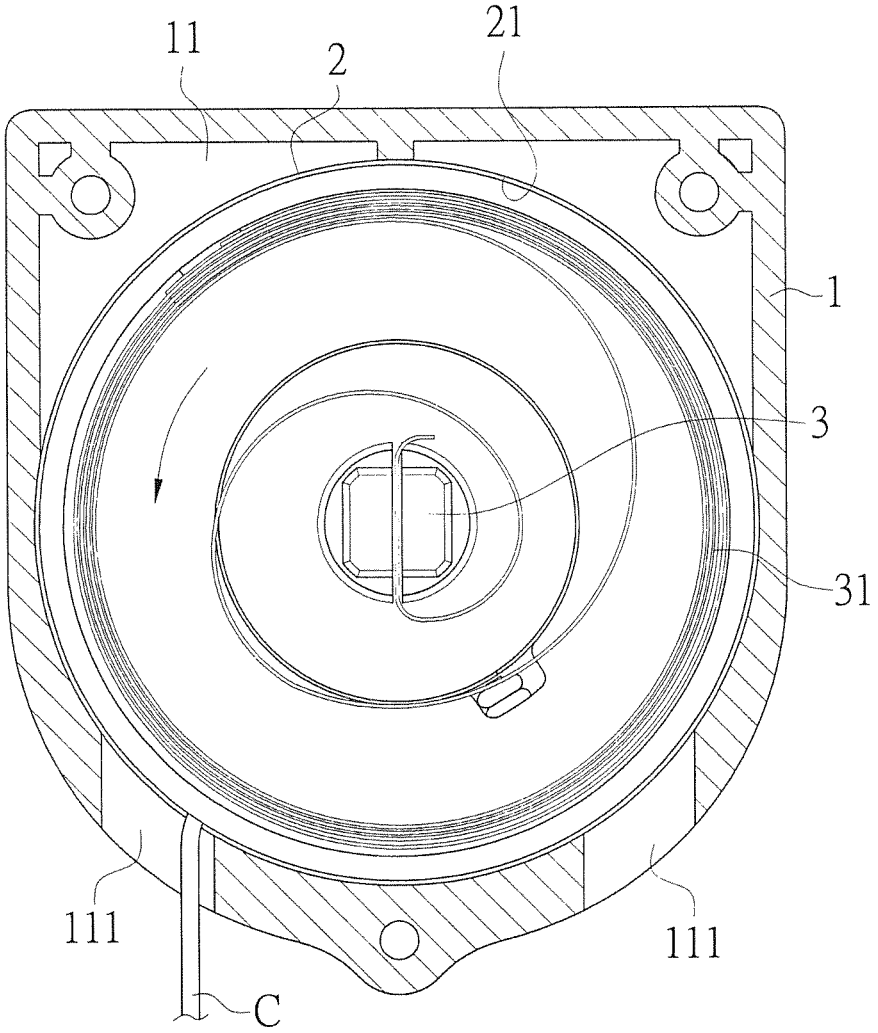
FIG. 4 is a schematic view showing the clock spring of the present invention in wound and compressed state.
Figure 5:
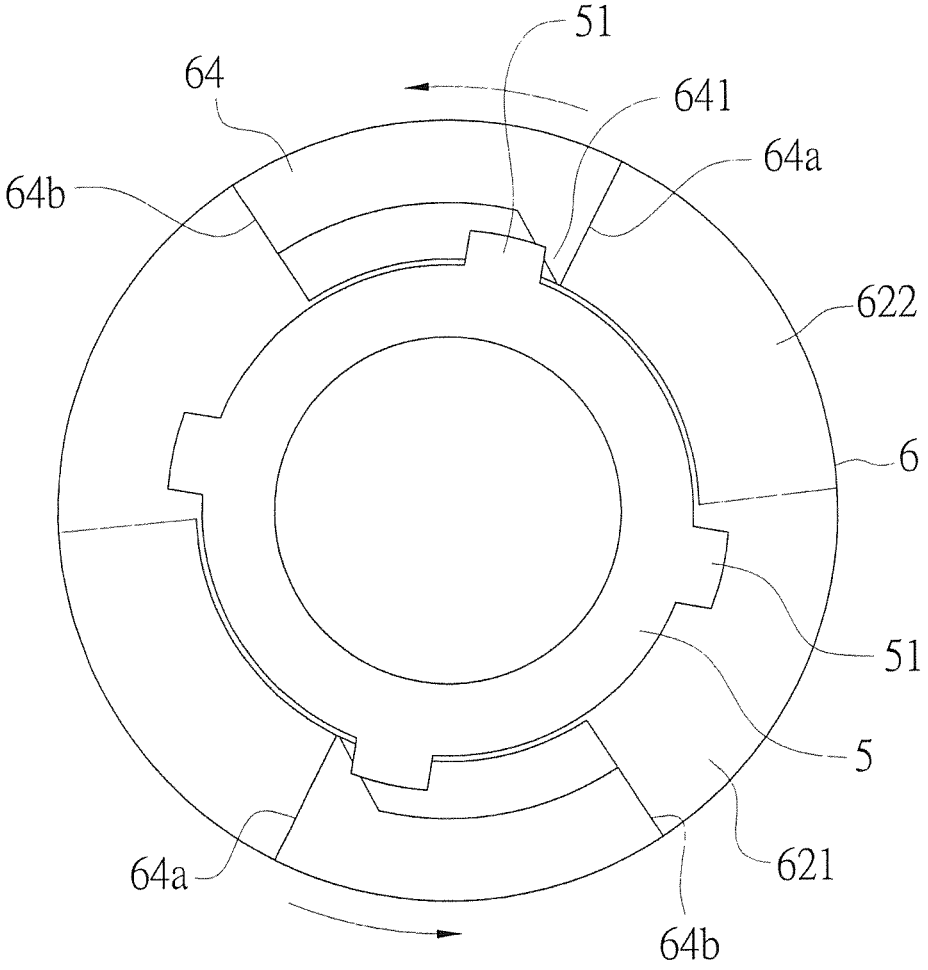
FIG. 5 is a schematic view (I) showing the correlated action of the outer bushing and the inner bushing of the present invention.
Figure 6:
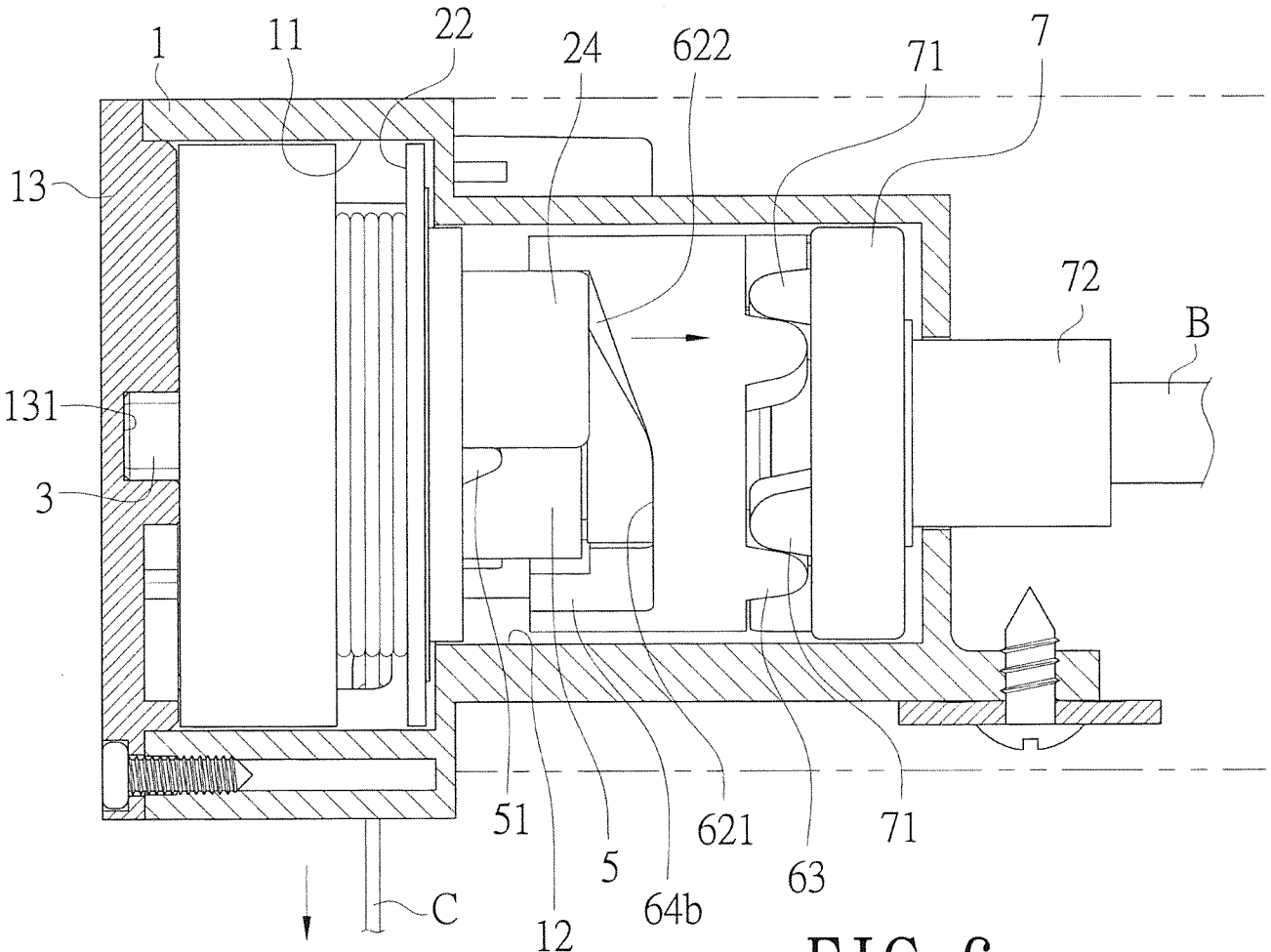
FIG. 6 is a sectional schematic side view of the action of the present invention.
Figure 7:
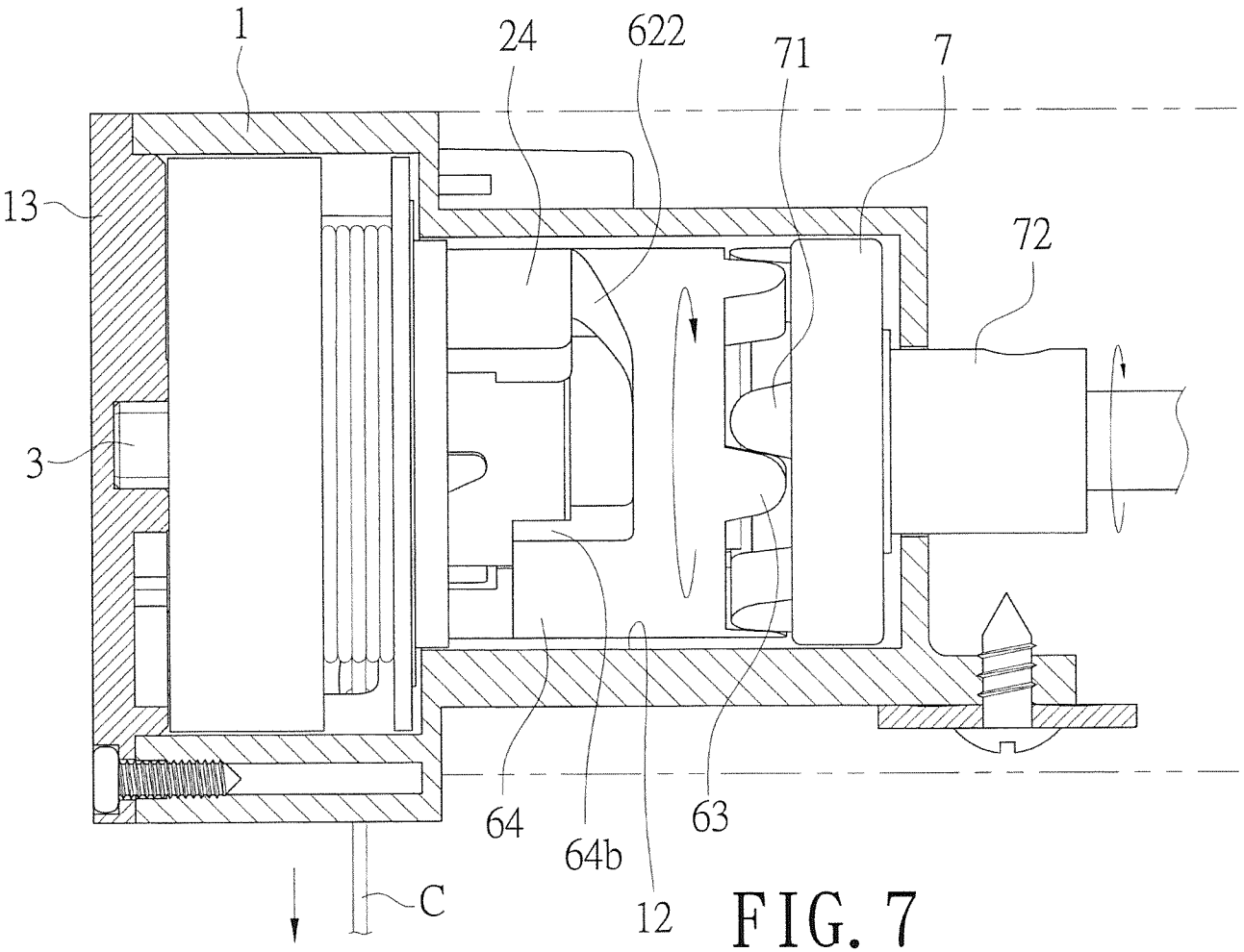
FIG. 7 is a sectional schematic side view of the action of the coupling unit of the present invention.

Referring to FIGS. 1 to 7, when in use, the pull-cord (C) in the winding passage (22) is firstly pulled so that the pull-cord (C) is pulled out through the cord hole (111) to drive the winding member (2) to rotate. As the first end of the first shaft member (3) is held in the stationary shaft holding depression (131) of the main control unit (1), the first shaft member (3) is unable to rotate. When the winding member (2) is rotated relative to the first shaft member (3), the clock spring (30) is wound to store energy, as shown in FIG. 4. Next, when the winding member (2) is rotated, the protruding blocks (24) are also rotated together so that the protruding blocks (24) located on the straight segments (621) are displaced toward the slant segments (622) on the aisle paths (62) [when the pull-cord (C) is not pulled yet, the protruding blocks (24) are located on the straight segments (621). At this moment, the outer bushing (6) is rotated in counterclockwise direction so that the projecting teeth (641) on the arc protruding sections (64) press against one sides of the projections (51) of the inner bushing (5), as shown in FIG. 5. Since the inner bushing (5) is rotated in a direction opposite to the spiral direction of the first torsion spring member (43), the first torsion spring member (43) is therefore twisted to expand in such a manner as to press against the inner wall surface of the inner bushing (5) so that the inner bushing (5) is restrained by the first torsion spring member (43) and is unable to rotate. Furthermore, as the protruding blocks (24) are now displaced on the slant segments (622), the outer bushing (6) is forced to displace backward so that the tooth portions (63) mesh with the tooth blocks (71) of the coupling unit (7), as shown in FIG. 6, simultaneously to compress the second torsion spring member (44) by the blocking edge (61). During the stroke of continuously pulling out the pull-cord (C), the protruding blocks (24) always press against first sides (64*a*) of the arc protruding sections (64) to continuously drive the outer bushing (6) to rotate so that the coupling unit (7) drives the mandrel rod (B) to rotate by the interlocking of the tooth portions (63) with the tooth blocks (71), as shown in FIG. 7. The mandrel rod (B) is additionally provided with a winding unit and a brake to control the roman shade [which are not the features of the present invention and therefore are omitted here]. When the mandrel rod (B) is rotated, the winding unit synchronously winds the drawstring so as to roll up the curtain fabric.

Figure 8:
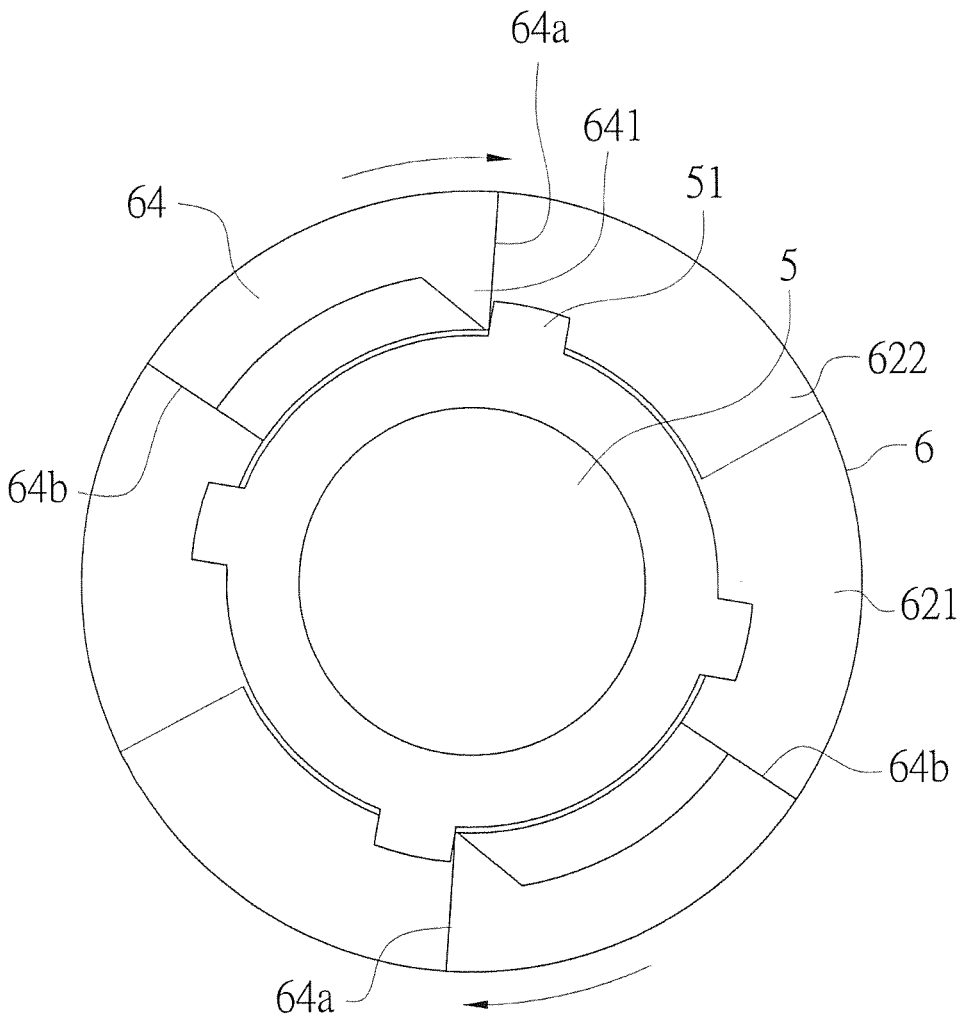
FIG. 8 is a schematic view (II) showing the correlated action of the outer bushing and the inner bushing of the present invention.
Figure 9:
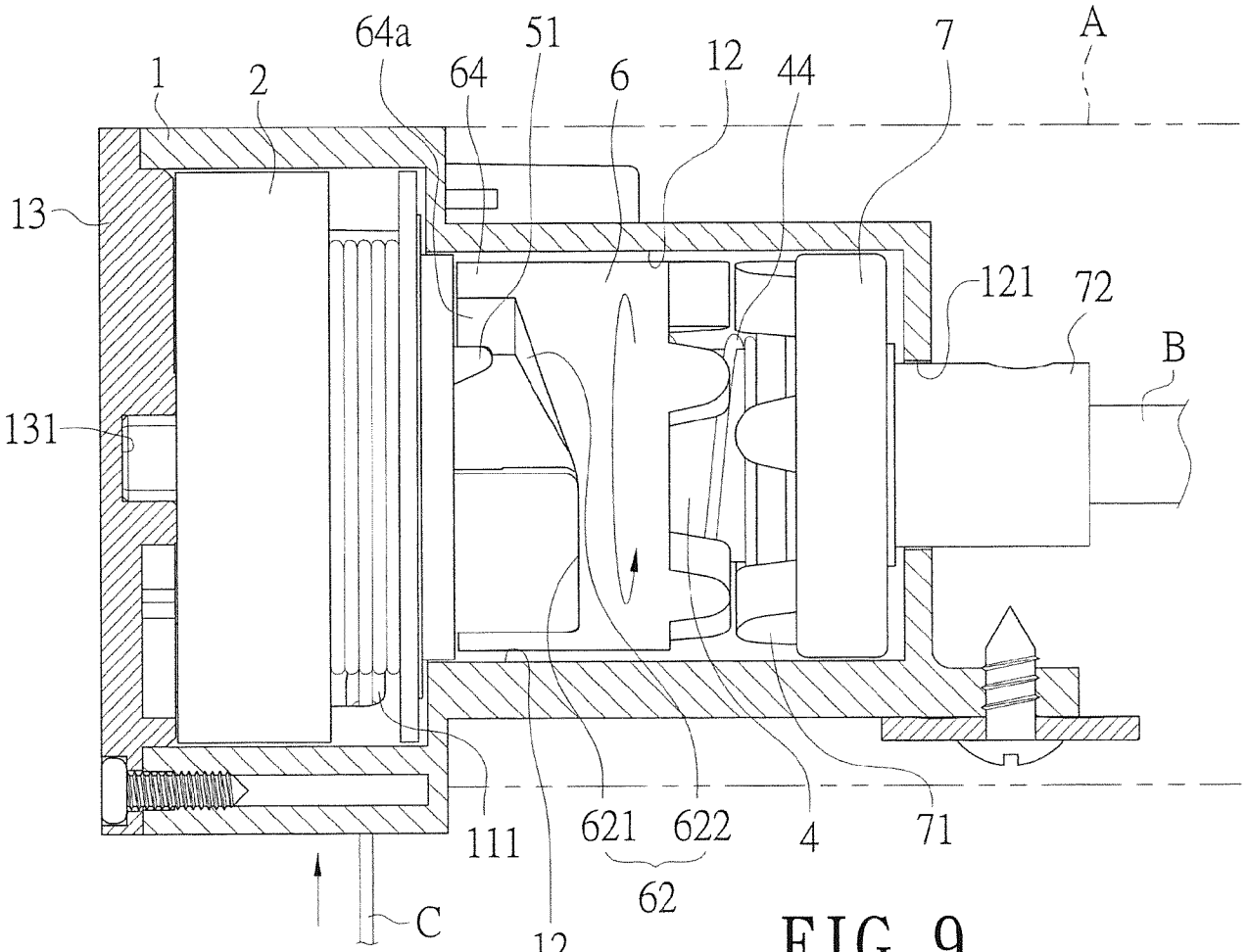
FIG. 9 is a sectional schematic side view showing the action of the winding member of the present invention to recover the winding of the pull-cord.

When the pull-cord (C) is released, referring to FIGS. 8 and 9, the clock spring (30) in wound state is unwound by its own spring force so as to drive the winding member (2) to rotate in opposite direction and simultaneously to wind the pull-cord (C) back into the winding passage (22). Further, the outer bushing (6) is no more pushed by the protruding blocks (24) so that the outer bushing (6) is recovered to its normal state by the spring force of the second torsion spring member (44), to allow the protruding blocks (24) returning back to the location on the straight segment (621). At this moment, the protruding blocks (24) of the winding member (2) moves in opposite direction to press against second sides (64*b*) of the arc protruding sections (64) to force the outer bushing to rotate in opposite direction, so that the projecting teeth (641) of the arc protruding sections (64) press against the other sides of the projections (51) of the inner bushing (5). Since the inner bushing (5) is rotated in the same direction as the spiral direction of the first torsion spring member (43), the inner bushing (5) and the outer bushing (6) can be rotated accompanying with the rotation of the winding member (2) in opposite direction. At the same time, as the coupling unit (7) is detached from the meshing with the tooth portions (63) of the outer bushing (6), the mandrel rod (B) is not driven to rotate and the curtain fabric is controlled by the brake to maintain in its folded state and the pull-cord (C) is wound back to its normal state in which only a small segment is exposed out for pulling. Therefore, dangerous state of strangulation by wrapping around children's neck can be effectively avoided to achieve the object of safety precaution.

Based on the foregoing description of the constitution and the implementation of the present invention, the present invention has the following advantages when comparing with conventional structures:

1. The present invention can conduct the up-down operation of the roman shade by a single pull-cord.

2. By the single pull-cord controller of the present invention, the up-down operation of the roman shade can be controlled by the pulling or releasing of the single pull-cord, and the pull-cord after manipulation can be wound within the controller by the recovery of the clock spring. Therefore, dangerous state of strangulation by wrapping around children's neck can be effectively avoided to achieve the object of safety precaution.

What is claimed is:

1. A single pull-cord controller of roman shade, mainly comprises:

a main control unit, with an outer sleeve fitted over its outside, has a first housing cavity and a second housing cavity with a central aperture provided at the end face; an open end of the first housing cavity is provided with an external cover which has a stationary shaft holding depression provided at its center so that the external cover can close the first housing cavity; a cord hole is further provided within the first housing cavity;

a winding member located correspondingly within the first housing cavity of the main control unit; the winding member has a chamber and a winding passage, a bore is provided at the center of the chamber for the passing-through of the winding member; the winding passage is provided outside the winding member so as to wind up a pull-cord, and the pull-cord pierces out through the cord hole; at least one protruding block is further provided on a wall surface of the winding member corresponding to the bore;

a first shaft member correspondingly provided in the bore of the winding member; a clock spring is inserted on a first end of the first shaft member and is located in the chamber of the winding member; the first end of the first shaft member is inserted in the stationary shaft holding depression;

a second shaft member, positioned in the second housing cavity of the main control unit, which has a first step segment and a second step segment, the inner diameter of the first step segment is fitted with the second end of the first shaft member; then, a first torsion spring member and a second torsion spring member are respectively fitted over the first step segment and the second step segment;

an inner bushing, enclosing over the first torsion spring member and fitted over the first step segment of the second shaft member; projections are provided on the outer periphery of the inner bushing;

an outer bushing, correspondingly fitted over the second step segment of the second shaft member; a blocking edge is provided within the inner diameter thereof, so as to correspondingly press against the second torsion spring member; the outer bushing has aisle paths provided correspondingly to the protruding blocks and the aisle paths are in moving contact with the protruding blocks; each of the aisle paths has a straight segment and a slant segment, and an arc protruding section is interposed between two aisle paths; each of the arc protruding sections is formed with a projecting teeth adjacent to the slant segment and extending in radial direction; the other end of the outer bushing opposite to the aisle paths is provided with tooth portions;

a coupling unit having tooth blocks corresponding to and detachably meshing with the tooth portions on the outer bushing; the coupling unit is located within the second housing cavity of the main control unit, and a shaft tube at one end of the coupling unit penetrates through the central aperture of the main control unit so as to connect with a mandrel rod of the window curtain.

2. The single pull-cord controller of roman shade as claimed in claim 1, wherein the first end of the first shaft member has a slit groove for inserting an inner end of the clock spring therein, while the chamber of the winding member is provided with a fixing tab on an inner wall thereof for fixing an outer end of the clock spring.

* * * * *